US005358114A

United States Patent [19]

Neugebauer

[11] Patent Number: 5,358,114

[45] Date of Patent: Oct. 25, 1994

[54] CARD HOLDER

[75] Inventor: Edward J. Neugebauer, Westlake, Ohio

[73] Assignee: Pro-Mold and Tool Company, Inc., Elyria, Ohio

[21] Appl. No.: 957,663

[22] Filed: Oct. 6, 1992

Related U.S. Application Data

[63] Continuation-in-part of Ser. No. 907,238, Jul. 1, 1992, Pat. No. 5,224,600.

[51] Int. Cl.[5] ..... B65D 85/48; B65D 85/62

[52] U.S. Cl. ..... 206/449; 206/39; 206/45.34; 150/147; 40/156; 40/661

[58] Field of Search ..... 206/449, 455, 456, 39, 206/45.34, 454; 40/156, 661; 150/145, 147

[56] References Cited

U.S. PATENT DOCUMENTS

| | | | |
|---|---|---|---|
| 2,125,208 | 7/1938 | Thomas . | |
| 4,322,001 | 3/1982 | Hurley | 206/449 |
| 4,829,691 | 5/1989 | Manjos et al. | 40/661 |
| 4,979,619 | 12/1990 | Hager | 206/509 |
| 5,010,673 | 4/1991 | Connor et al. | 40/661 |
| 5,040,671 | 8/1991 | Hager | 206/39 |
| 5,046,616 | 9/1991 | Makowski et al. | 206/467 |
| 5,097,953 | 3/1992 | Gingras | 206/449 |
| 5,119,574 | 6/1992 | King | 206/454 X |
| 5,121,563 | 6/1992 | Connor et al. | 40/661 |
| 5,133,450 | 7/1992 | Rademacher | 206/44 |
| 5,224,600 | 7/1993 | Neugebauer | 206/449 |

OTHER PUBLICATIONS

Motion for Summary Judgment, *Pro-Mold and Tool Co., Inc. v. Great Lakes Plastics.*

Memorandum in Opposition to Motion for Summary Judgment, *Pro-Mold and Tool Co., Inc. v. Great Lakes Plastics.*

*Primary Examiner*—William I. Price

*Attorney, Agent, or Firm*—Thompson, Hine and Flory

[57] ABSTRACT

A card holder including a transparent base having a lip extending around the periphery of the base thereby forming a pocket for receiving a card. The card holder further includes a transparent cover having a transparent flat plate frictionally engaging the lip of the base for holding the base and cover together. The difference between the thickness of the plate and the height of the lip must exceed the thickness of the card thereby forming a compartment for holding the card.

13 Claims, 2 Drawing Sheets

CARD HOLDER

BACKGROUND OF THE INVENTION

This application is a continuation-in-part of U.S. patent application Ser. No. 07/907,238 entitled CARD HOLDER filed Jul. 1, 1992 now U.S. Pat. No. 5,224,600.

FIELD OF THE INVENTION

The present invention relates generally to devices for holding cards and more particularly pertains to a card holder suitable for the protection and presentation of sports cards, photographs and the like.

DESCRIPTION OF THE PRIOR ART

The collection, buying, selling and trading of sports cards has created a need for a means to easily and inexpensively display, protect and store such cards. Consequently, numerous card holders have been designed. For example, a cardcase is described in U.S. Pat. No. 4,979,619 issued to A. Hager on Dec. 25, 1990. The cardcase is comprised of two transparent flat plastic panels. A first panel has molded therein first and second recesses for holding two items. A second panel contains a peripheral lip which engages a notched perimeter of the first panel thereby forming the cardcase. The joint between the panels is preferably bonded by ultrasonic or other means. Outer surfaces of each of the panels further include mating ridges permitting several cardcases to be interlocked with each other thereby facilitating storage and transportation.

The designs of known cardcases have the disadvantage of being too large to file with unprotected cards in standard set storage boxes. Referring to FIG. 6 of U.S. Pat. No. 4,979,619 issued to Hager, all of those designs are the same in that a first piece 11 with a peripheral lip receives a second piece 12 which has a relief or recess 26 molded into the second piece. The second piece has a peripheral surface 25 extending around the recess. When the cardcase is assembled, the surface 25 contacts the first piece 11 providing additional strength and rigidity. However, the surface 25 increases the overall size of the cardcase thereby preventing the cardcase from being filed with unprotected cards in standard set storage boxes.

Further, many designs such as the Hager design may have ridges 18 and mating ridges 23 or notches on opposing outer surfaces which facilitate joining several cardcases together. However, such projections on outer surfaces will potentially damage unprotected cards if such cardcases are stored with unprotected cards.

SUMMARY OF THE INVENTION

The card holder of the present invention comprises a transparent base having a lip extending around a flat first surface thereby forming a pocket for receiving a card. The height of the lip on the base can be varied forming a small pocket for receiving one card or a larger pocket for receiving a plurality of cards. The card holder further includes a transparent cover having a transparent plate with a flat second surface centrally located on the cover and forming a stepped contour about the perimeter of the cover. Upon the base and cover being joined together, the lip of the base receives and frictionally engages the sides of the plate of the cover thereby holding the base and cover together. Further, the lip contacts a peripheral edge on the cover thereby establishing a separation between the first and second surfaces greater than the thickness of the card. The separation between the first and second surfaces can be increased to permit a plurality of cards to be retained in the pocket. As such, the greater the separation, the greater number of cards to be retained therein.

Many collectors desire to keep their cards in a particular order in which more valuable cards are stored with cards of lesser value. The card holder of the present invention has an advantage of being only slightly larger than a standard card and therefore conveniently fits in standard card set storage boxes along with cards that are unprotected. The flat, smooth sides of the card holder prevent damage to adjacent unprotected cards with which the card holder is stored.

The claimed card holder also permits the display of both sides of the card, protects the card during normal handling and storage, provides a base and cover that frictionally engage as a unit but may be easily separated for card exchange. Further, the thickness of the transparent plate gives the appearance of depth when viewing the card.

DESCRIPTION OF THE PREFERRED EMBODIMENTS

Figure 1:
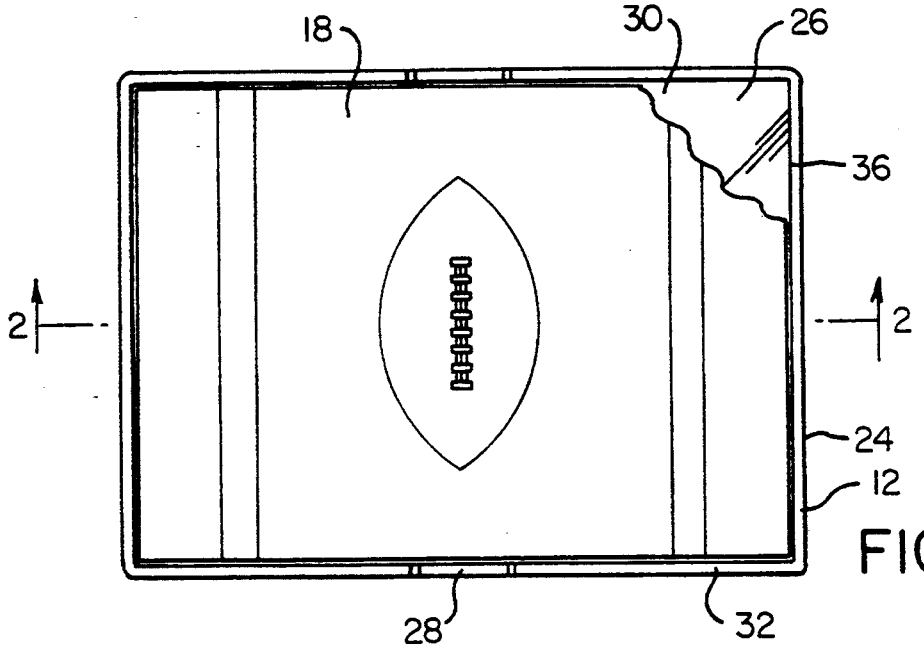
FIG. 1 is a top view of the base of the card holder.

Referring to FIGS. 1 through 5, a card holder 10 of the present invention is comprised of a transparent base 12 which frictionally engages a transparent cover 14 thereby forming a compartment 16 in which the card 18 is held. Preferably, the card holder is injected molded from crystalline polystyrene.

Figure 2:
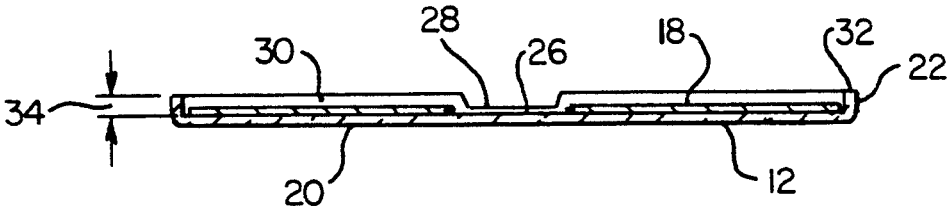
FIG. 2 is a sectional view taken along line 2—2 of FIG. 1.

Referring to FIGS. 1 and 2, the base 12 is rectangular in shape and made from clear rigid material. The base 12 has a smooth, flat outer surface 20, and a lip 22 extending about a first perimeter 24. The lip 22 bounds a flat first surface 26. The lip 22 may have one or more discontinuities about the first perimeter 24 thereby forming one or more notches 28 on the first perimeter 24. The lip 22 projects approximately perpendicular from the first surface 26.

In one embodiment of the present invention, the lip 22 projects approximately perpendicularly from the first surface 26 a distance which is the lip height surface 34 to form a pocket 30 for receiving the card 18.

A lip edge surface 32 extends along the lip 22 in a plane approximately parallel to the first surface 26. The lip 22 has a height measured perpendicularly from the first inner surface 26 to the lip edge surface 32. A lip height surface 34 is defined by the extension of the lip height around a perimeter 36 of the first surface 26.

Figure 3:
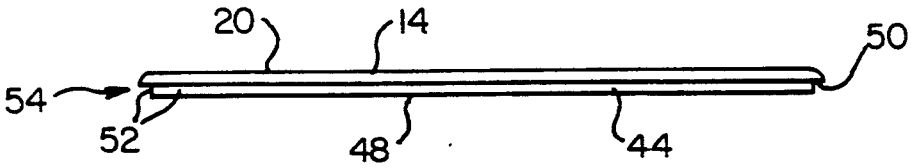
FIG. 3 is a side view of the cover of the card holder.
Figure 4:
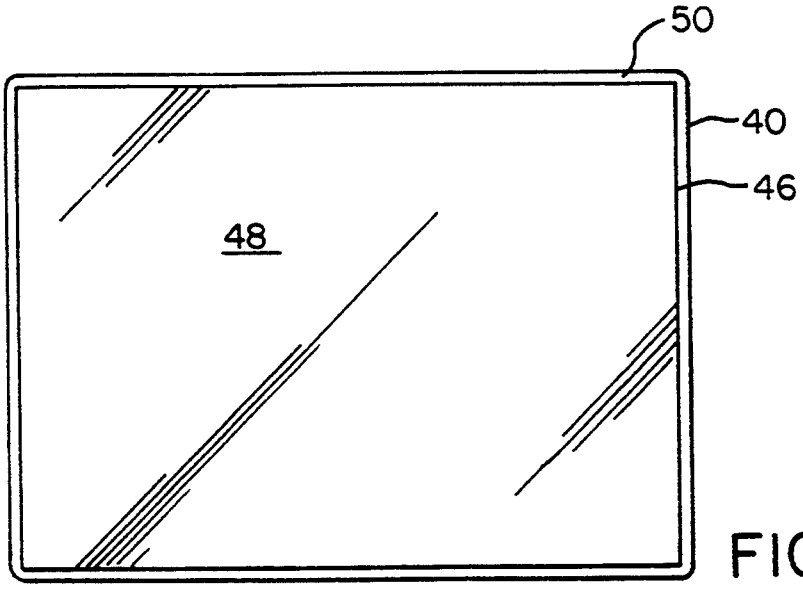
FIG. 4 is a bottom view of the cover of the card holder.

FIGS. 3 and 4 illustrate a cover 14 which is preferably made from the same clear rigid material as the base 12. The cover has a second perimeter 40 which preferably is equal to the first perimeter 24. The cover 14 includes a transparent plate 44 which is centrally located on the cover 14. The plate 44 increases the rigidity of the cover thereby making the cover less susceptible to warpage and forces that would bend the cover into contact with the card face. The plate 44 also functions as a lens that may provide the appearance of depth when viewing the card 18. The plate 44 has a thickness and a third perimeter 46 less than the second perimeter 40. The third perimeter 46 defines a boundary of a flat second surface 48. The cover 14 also has a peripheral surface 50 bounded by the second perimeter 40 and the third perimeter 46. The plate has a side surface 52 having an area defined by the thickness of the plate 44 and the third perimeter 46. A stepped contour 54 is formed by the plate side surface 52 and the peripheral surface 50.

Figure 5:
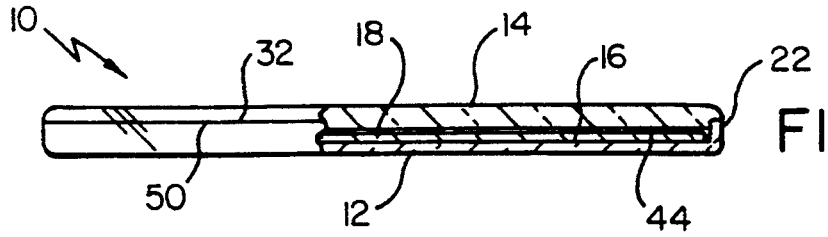
FIG. 5 is a side view of the assembled card holder shown partly in section.

As shown in FIG. 5, the compartment 16 for holding the card 18 is formed by bringing the base 12 and cover 14 together such that the lip 22 receives and frictionally engages the plate 44. The height of the lip 22 and the thickness of the plate 44 are chosen such that when the lip edge surface 32 is brought into a contacting relationship with the peripheral surface 50, the separation between the first surface 26 and the second surface 48 is greater than the thickness of the card 18. Consequently, the pocket 30 for holding one or more of the cards is inherent in the base, as opposed to being created by a recess or relief in the cover as with other cardcases. In the present invention, the second surface 48 is flat which by definition means that it does not contain a recess or relief.

The lip height surface 34 and the plate side surface 52 are manufactured such that the lip height surface 34 engages the plate side surface 52 in an interference fit. For example, the lip height surface 34 flares outwardly from the first surface 26 to the lip edge surface 32 by approximately 3 degrees from a normal to the first surface 26. Further, the plate side surface 52 tapers inwardly from the peripheral surface 50 to the second surface 48 by approximately 3 degrees from a normal to the second surface 48. The flare of the lip height surface 34 and the taper of the plate side surface 52 may be varied to adjust the frictional forces holding the base 12 and the cover 14 together.

Figure 6:
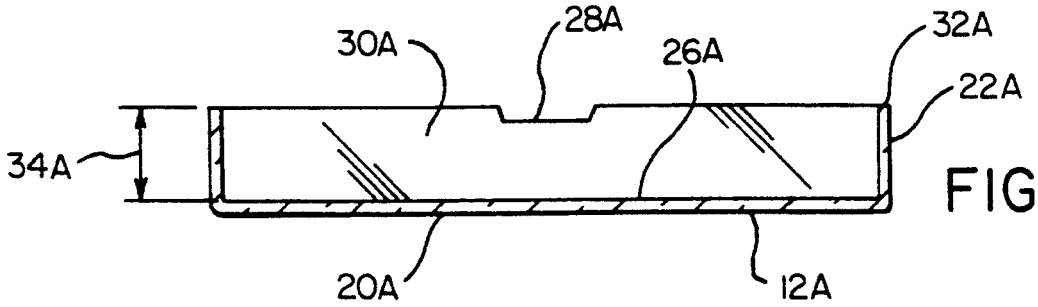
FIG. 6 is a sectional view taken along line 2—2 of FIG. 1 for a cardholder designed to retain a plurality of cards stacked on top of each other.

As shown in FIG. 6, the base 12A can be constructed to receive a plurality of cards stacked on top of each other. The base 12A is rectangular and made from a clear rigid material. The base 12A has a smooth, flat outer surface 20A and an extended lip or wall member 22A extending about the first perimeter. The wall member 22A may have one or more discontinuities about the first perimeter thereby forming one or more notches 28A on the first perimeter.

The lip edge surface 32A extends along the wall member 22A in a plane approximately parallel to the first surface 26A. The wall member 22A has a height measured perpendicularly from the first inner surface 26A to the lip edge surface 32A to accommodate a plurality of cards. Additionally, transparent cover 14 frictionally engages with the lip 32A of wall member 22A to retain the cover on the base.

The present invention is preferably designed for the display of baseball cards and an advantage of the invention is that the card holder is only slightly larger than the size of the baseball card, thereby permitting the cardholder to be stored in standard card set boxes along with unprotected cards. Such a design is possible because baseball cards, other sports cards, photographs, etc., are most often made to a predetermined shape and size. A card face will have a predetermined rectangular area and a predetermined width and length. Consequently, the first surface 26 of the base 12, and the second surface 48 of the cover 14, have an area approximately equal to a predetermined area of the face of the card. In order to manufacture a base having reasonable strength, the width of the lip on all sides of the base must be at least 0.030 inches. Therefore, assuming that a card fits perfectly on the first surface, the cover and base members must have lengths and widths at least 0.060 inches greater than the predetermined length and width of the baseball card.

It is preferable that the area of the first surface be slightly larger than the area of the face of the card to accommodate dimensional variations in the manufacture of the card. For example, the length and width of the first and second surfaces may be up to 0.040 inches greater than the predetermined length and width, respectively, of the card. In the preferred embodiment, the width of the lip 22 ranges from 0.050 inches to 0.075 inches. Preferably the width of the lip along the width of the base is approximately 0.015 inches less than the width of the lip along the length of the base. Finally, it is preferred that there be a clearance of at least 0.030 inches between the length of the card holder and the width of the tray in a standard card set box in which the card holder is to be stored. Further, such boxes may be manufactured to different tolerances. Therefore, the length and width of the base and cover of the card holder exceeds the predetermined length of a baseball card by a range of from 0.030 inches to 0.250 inches and preferably 0.060 to 0.125 inch.

The cover is strengthened by inserting a fillet at the intersection of the lip height surface 34 and the first surface 26. The fillet provides a transition between those two surfaces and extends at 45 degrees from the first surface 26 over a width of approximately 0.025 inches. The fillet extends the length of the perimeter 36. In the preferred embodiment, for additional rigidity, the thickness of the base member is approximately 0.078 inches which is approximately 15% greater than the thickness of other designs known to applicant. The height of the lip is approximately 0.084 inch; and therefore, the total height of the base from the outer surface 20 to the lip edge surface 32 is 0.162 inches. The thickness of the cover is approximately 0.100 inches, while the thickness of the plate on the cover is approximately 0.055 inches. The exterior corners of the base and cover may have rounded corners, for example, radii of 0.030 inches to 0.060 inches may be used to provide desired corner roundness.

It should be noted that the described card holder is subject to other variations within the scope of the appended claims. For example, although the preferred embodiment is illustrated with two notches 28, as shown in FIG. 1, the card holder may also be made with a single notch anywhere on the perimeter of the base or with no notches.

It should also be noted that the type of cards is not limited to baseball cards. Other type of collectable cards such as, but not limited to, football cards, basketball cards, cartoon character cards, television show and motion picture cards, photographs, and other collectibles that may be contained in the present invention.

While the invention has been illustrated in some detail according to the preferred embodiment shown in the accompanying drawings and while the preferred embodiments have been described in some detail, there is no intention to thus limit the invention to such detail. On the contrary, it is intended to cover all modifications, alterations and equivalents falling within the spirit and scope of the appended claims.

What is claimed is:

1. A card holder for displaying a plurality of cards having a thickness and a face of a predetermined area, the card holder consisting essentially of:

a transparent rectangular base having a first perimeter and a lip extending along the first perimeter, said lip projecting approximately perpendicularly from and bounding a flat first surface, whereby said lip and said first surface form a rectangular pocket for receiving the plurality of cards, the length and width of said lip being only slightly larger than the length and width of said card; and a transparent rectangular cover having a second perimeter approximately equal to said first perimeter, said cover including a transparent rectangular plate centrally located therein, said plate having a thickness, a third perimeter less than said second perimeter and a flat rectangular second surface bounded by said third perimeter, said card cover further having a peripheral surface bounded by said second and said third perimeters, whereby upon said base and said cover being assembled, said lip receives and frictionally engages said plate, and said lip contacts said peripheral surface of said cover thereby establishing a separation between said first and second surfaces slightly greater than the thickness of said plurality of cards, the length and width of said cover being the same as the length and width of said face.

2. The card holder of claim 1 wherein the first and second surfaces have areas approximately equal to the predetermined area of the face of the card.

3. The card holder of claim 1 wherein the face of the card is a rectangular shape having a predetermined length and a predetermined width and the base and cover are rectangular shapes having lengths and widths exceeding the predetermined height and width of the face by a range of from 0.060 inches to 0.030 inches.

4. The card holder of claim 3 wherein the base and cover have flat, smooth outer surfaces opposite and approximately parallel to the first and second surfaces of the base and cover, respectively.

5. The card holder of claim 1 wherein said lip on said base has a substantially rectangular cross section, a lip edge surface in a plane approximately parallel to said first surface, a lip height measured perpendicularly from said first surface to the lip edge surface, and a lip height surface defined by said height of the lip and extending about said perimeter of the first surface.

6. The card holder of claim 5 wherein said plate includes a side surface defined by said thickness of said plate and extending about said third perimeter, said cover further includes a stepped contour formed by said peripheral surface and said side surface of said plate whereby upon said base and cover being assembled said lip height surface engages said side surface in an interference fit to hold the base and cover together, and said lip edge surface has a contacting relationship with said peripheral surface to establish said separation between the first and second surfaces.

7. The card holder according to claim 5 wherein the height of said lip exceeds said thickness of said plate by an amount greater than the thickness of the plurality of the cards.

8. The card holder according to claim 1 wherein said base and cover are made of a clear rigid material.

9. The card holder of claim 1 wherein said lip extends along said first perimeter a distance less than the first perimeter thereby forming a notch on the first perimeter.

10. The card holder of claim 1 wherein the card is a sports card.

11. The card holder of claim 4 wherein said card holder is dimensioned such that said card holder can be stacked in a planar parallel relationship with a plurality of said cards not contained in card holders and stored with said cards in a conventional set storage box.

12. The card holder of claim 1 wherein said lip extends from said first surface a distance to form a compartment for receiving a plurality of said cards.

13. The card holder according to claim 12 wherein said base and cover are injection molded from crystalline polystyrene.

* * * * *

UNITED STATES PATENT AND TRADEMARK OFFICE

CERTIFICATE OF CORRECTION

PATENT NO. : 5,358,114

DATED : October 25, 1994

INVENTOR(S) : Edward J. Neugebauer

It is certified that error appears in the above-identified patent and that said Letters Patent is hereby corrected as shown below:

In Col. 5, line 43, "0.030" should read --0.30--.

In Col. 5, line 44, "the" (second occurrence), should read --said--.

In Col. 6, line 2, "the" should read --said--.

In Col. 6, line 8, "the" should read --said--.

Signed and Sealed this

Tenth Day of January, 1995

*Attest:*

*Attesting Officer*

BRUCE LEHMAN

*Commissioner of Patents and Trademarks*